US011634857B2

(12) United States Patent
Masters

(10) Patent No.: US 11,634,857 B2
(45) **Date of Patent: *Apr. 25, 2023**

(54) LAUNDRY TREATING APPLIANCE HAVING SENSORS, AND METHODS OF OPERATION

(71) Applicant: WHIRLPOOL CORPORATION, Benton Harbor, MI (US)

(72) Inventor: Roy E. Masters, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 93 days.

This patent is subject to a terminal disclaimer.

(21) Appl. No.: 17/234,977

(22) Filed: Apr. 20, 2021

(65) Prior Publication Data

US 2021/0254268 A1 Aug. 19, 2021

Related U.S. Application Data

(63) Continuation of application No. 16/586,857, filed on Sep. 27, 2019, now Pat. No. 11,008,697.

(51) Int. Cl.
*D06F 58/30* (2020.01)
*D06F 29/00* (2006.01)
(Continued)

(52) U.S. Cl.
CPC ..... *D06F 58/30* (2020.02); *D06F 29/005* (2013.01); *D06F 58/26* (2013.01); *D06F 58/38* (2020.02);
(Continued)

(58) Field of Classification Search
CPC ..... D06F 58/26; D06F 58/30; D06F 58/38; D06F 29/005; D06F 2103/08; D06F 2103/38; D06F 2103/12
(Continued)

(56) References Cited

U.S. PATENT DOCUMENTS 5,347,727 A ‡ 9/1994 Kim ..... D06F 58/30 34/491
6,122,840 A ‡ 9/2000 Chbat ..... D06F 58/46 34/496
(Continued)

FOREIGN PATENT DOCUMENTS

CA 2661211 A1 2/2008
CA 2661211 C ‡ 3/2013 ..... D06F 58/10
(Continued)

OTHER PUBLICATIONS

European Search Report for Counterpart EP20197931.7, dated Dec. 8, 2020.‡
(Continued)

*Primary Examiner* — Stephen M Gravini
(74) *Attorney, Agent, or Firm* — McGarry Bair PC

(57) ABSTRACT

A laundry treating appliance for treating laundry according to an automatic cycle of operation includes a cabinet defining a cabinet interior. A drum is rotatable within the cabinet interior, and at least partially defines a treating chamber. The treating chamber has a treating chamber air inlet and a treating chamber air outlet. A drying air circuit is fluidly coupled to the treating chamber air inlet and to the treating chamber air outlet. The laundry treating appliance can include first and second air temperature sensors, at least a first humidity sensor, and a controller operably coupled with the sensors.

20 Claims, 5 Drawing Sheets

(51) Int. Cl.

| | |
|---|---|
| ***D06F 58/26*** | (2006.01) |
| ***D06F 103/08*** | (2020.01) |
| ***D06F 103/38*** | (2020.01) |
| ***D06F 103/12*** | (2020.01) |
| ***D06F 58/38*** | (2020.01) |

(52) U.S. Cl.
CPC ..... *D06F 2103/08* (2020.02); *D06F 2103/12* (2020.02); *D06F 2103/38* (2020.02)

(58) Field of Classification Search
USPC ..... 34/486
See application file for complete search history.

(56) References Cited

U.S. PATENT DOCUMENTS

| | | | | |
|---|---|---|---|---|
| 7,228,647 | B2 ‡ | 6/2007 | Hong | D06F 58/24 34/596 |
| 7,665,225 | B2 ‡ | 2/2010 | Goldberg | D06F 25/00 34/73 |
| 7,695,524 | B2 ‡ | 4/2010 | Wright | D06F 43/007 8/142 |
| 7,739,891 | B2 ‡ | 6/2010 | Luckman | D06F 43/085 68/124 |
| 7,765,715 | B2 ‡ | 8/2010 | Kim | D06F 58/30 34/491 |
| 7,900,374 | B2 ‡ | 3/2011 | Bae | D06F 58/30 34/491 |
| 7,908,766 | B2 ‡ | 3/2011 | Ahn | D06F 58/02 34/595 |
| 8,347,520 | B2 ‡ | 1/2013 | Kuwabara | D06F 58/206 34/73 |
| 8,443,527 | B2 ‡ | 5/2013 | Bellinetto | G01K 13/00 34/269 |
| 8,701,309 | B2 ‡ | 4/2014 | Park | D06F 58/04 34/487 |
| 8,839,527 | B2 ‡ | 9/2014 | Ben-Shmuel | F26B 3/347 34/260 |
| 8,863,400 | B2 ‡ | 10/2014 | Ahn | D06F 58/02 34/74 |
| 9,745,682 | B2 ‡ | 8/2017 | Park | D06F 58/10 |
| 9,745,690 | B2 ‡ | 8/2017 | Lee | D06F 58/20 |
| 9,834,882 | B2 ‡ | 12/2017 | Patil | F26B 21/086 |
| 10,060,072 | B2 ‡ | 8/2018 | Huang | G01J 5/12 |
| 10,184,208 | B2 ‡ | 1/2019 | Rizzi | D06F 58/02 |
| 10,392,740 | B2 ‡ | 8/2019 | Chernetski | D06F 58/10 |
| 10,443,182 | B2 ‡ | 10/2019 | Adkins | D06F 58/30 |
| 10,506,907 | B2 ‡ | 12/2019 | Bertsch | A47L 15/0034 |
| 10,669,667 | B2 ‡ | 6/2020 | Prajescu | D06F 58/02 |
| 10,704,189 | B2 ‡ | 7/2020 | Christensen | D06F 25/00 |
| 10,738,409 | B2 ‡ | 8/2020 | Adkins | D06F 58/30 |
| 10,815,611 | B2 ‡ | 10/2020 | Carow | D06F 58/30 |
| 11,255,042 | B2 * | 2/2022 | Choung | H04B 7/0413 |
| 2013/0340278 | A1 ‡ | 12/2013 | Pillot | D06F 58/206 34/524 |
| 2016/0076193 | A1 ‡ | 3/2016 | Santillan Galvan | G05B 15/02 700/275 |
| 2020/0318282 | A1 ‡ | 10/2020 | Christensen | D06F 25/00 |
| 2021/0254268 | A1 * | 8/2021 | Masters | D06F 29/005 |

FOREIGN PATENT DOCUMENTS

| | | | | |
|---|---|---|---|---|
| CN | 101168895 | A | 4/2008 | |
| CN | 101787638 | A | 7/2010 | |
| CN | 101792967 | B | 9/2013 | |
| CN | 103882654 | A | 6/2014 | |
| CN | 104066881 | A | 9/2014 | |
| EP | 1895041 | B1 ‡ | 3/2012 | D06F 39/125 |
| EP | 1895041 | B1 | 3/2012 | |
| EP | 2460926 | A1 ‡ | 6/2012 | F26B 23/001 |
| EP | 2460926 | A1 | 6/2012 | |
| EP | 2487291 | A1 ‡ | 8/2012 | D06F 58/08 |
| EP | 2487291 | A1 | 8/2012 | |
| EP | 2653602 | A1 ‡ | 10/2013 | F26B 21/00 |
| EP | 2653602 | A1 | 10/2013 | |
| EP | 2977503 | A1 | 1/2016 | |
| EP | 3284860 | A1 | 2/2018 | |
| EP | 3284860 | A1 ‡ | 2/2018 | G05B 13/048 |
| EP | 2977503 | B1 ‡ | 4/2019 | D06F 58/02 |
| EP | 3798355 | A1 * | 3/2021 | D06F 29/005 |
| WO | 2008023909 | A2 | 2/2008 | |
| WO | WO-WO-2008023909 | A3 ‡ | 7/2008 | D06F 29/00 |
| WO | 2012072693 | A2 | 6/2012 | |
| WO | WO-WO-2012072693 | A3 ‡ | 8/2012 | F26B 23/001 |
| WO | 2016012228 | A1 | 1/2016 | |
| WO | WO-WO-2016012228 | A1 ‡ | 1/2016 | D06F 58/24 |

OTHER PUBLICATIONS

Chinese Office Action Issued in Counterpart CN202010886322.6, dated Aug. 12, 2022, 6 Pages.

* cited by examiner
‡ imported from a related application

LAUNDRY TREATING APPLIANCE HAVING SENSORS, AND METHODS OF OPERATION

CROSS-REFERENCE TO RELATED APPLICATION(S)

This application claims priority to and is a continuation application of U.S. patent application Ser. No. 16/586,857, filed Sep. 27, 2019, now U.S. Pat. No. 11,008,697, issued May 18, 2021, which is incorporated herein by reference in its entirety.

BACKGROUND

Laundry treating appliances, such as washing machines, combination washer/dryers, refreshers, and non-aqueous systems, can have a configuration based on a rotating laundry basket or drum that defines a drum opening and at least partially defines a treating chamber in which laundry items are placed for treating. The laundry treating appliance can have a controller that implements a number of user-selectable, pre-programmed cycles of operation having one or more operating parameters. Hot air, cold air, or a mixture thereof can be supplied to the treating chamber in accordance with the cycle of operation and via a drying air circuit.

In laundry treating appliances with drying air circuits, typically a heater and a blower are provided in the drying air circuit to supply heated drying air through the treating chamber to evaporate moisture from a load of laundry. In an open loop circuit, the blower can then move moisture-laden process air exiting the treating chamber to an exterior of the laundry treating appliance, such as outside of the building within which the laundry treating appliance is located. In a closed loop circuit, the moisture-laden process air can pass through a condenser to remove the moisture from the process air, the process air can be heated again by the heater, and the heated drying air can be supplied back into the treating chamber for continued drying.

BRIEF SUMMARY

In one aspect, the present disclosure relates to a laundry treating appliance for treating laundry according to an automatic cycle of operation, the laundry treating appliance comprising a cabinet defining a cabinet interior, a drum, rotatable within the cabinet interior, and at least partially defining a treating chamber, the treating chamber having a treating chamber air inlet and a treating chamber air outlet, a drying air circuit fluidly coupled to the treating chamber air inlet and to the treating chamber air outlet, a first air temperature sensor provided in the drying air circuit and outputting a first signal indicative of an inlet air temperature of drying air in the drying air circuit that flows through the treating chamber air inlet, a second air temperature sensor provided in the drying air circuit and outputting a second signal indicative of an outlet air temperature of the drying air exiting the treating chamber air outlet, at least a first humidity sensor provided in the drying air circuit and outputting a third signal indicative of an inlet air humidity value of the drying air entering the treating chamber air inlet, and a controller estimating an air flow rate through the drying air circuit, and further operably coupled with the first and second air temperature sensors and the first humidity sensor to receive and process the first, second, and third signals and the estimated air flow rate to determine an outlet air humidity value of the drying air exiting the treating chamber air outlet.

In another aspect, the present disclosure relates to a laundry treating appliance for treating laundry according to an automatic cycle of operation, the laundry treating appliance comprising a cabinet defining a cabinet interior, a drum, rotatable within the cabinet interior, and at least partially defining a treating chamber, the treating chamber having a treating chamber air inlet and a treating chamber air outlet, a drying air circuit fluidly coupled to the treating chamber air inlet and to the treating chamber air outlet, wherein the drying air circuit is a closed loop circuit, a first air temperature sensor provided in the drying air circuit and outputting a first signal indicative of a first air temperature of drying air in the drying air circuit, a second air temperature sensor provided in the drying air circuit and outputting a second signal indicative of a second air temperature of the drying air in the drying air circuit, at least a first humidity sensor provided in the drying air circuit and outputting a third signal indicative of a first air humidity value of the drying air, and a controller estimating an air flow rate through the drying air circuit, and further operably coupled with the first and second air temperature sensors and the first humidity sensor to receive and process the first, second, and third signals and the estimated air flow rate to determine a second air humidity value of the drying air and to estimate a remaining drying time for the laundry based on the determined second air humidity value.

In yet another aspect, the present disclosure relates to a method of operating a laundry treating appliance with a treating chamber for treating a load of laundry according to a drying cycle of operation, the method comprising supplying, by a drying air circuit, drying air to the treating chamber during the drying cycle of operation, sensing, with a first air temperature sensor provided in the drying air circuit, a first signal indicative of an inlet air temperature of the drying air in the drying air circuit that flows through a treating chamber air inlet, sensing, with a second air temperature sensor provided in the drying air circuit, a second signal indicative of an outlet air temperature of the drying air exiting a treating chamber air outlet, sensing, with at least a first humidity sensor provided in the drying air circuit, a third signal indicative of an inlet air humidity value of the drying air entering the treating chamber air inlet, estimating, by a controller, an air flow rate through the treating chamber, and determining, by the controller, an outlet air humidity value based on the first, second, and third signals and the estimated air flow rate.

DETAILED DESCRIPTION

Figure 1:
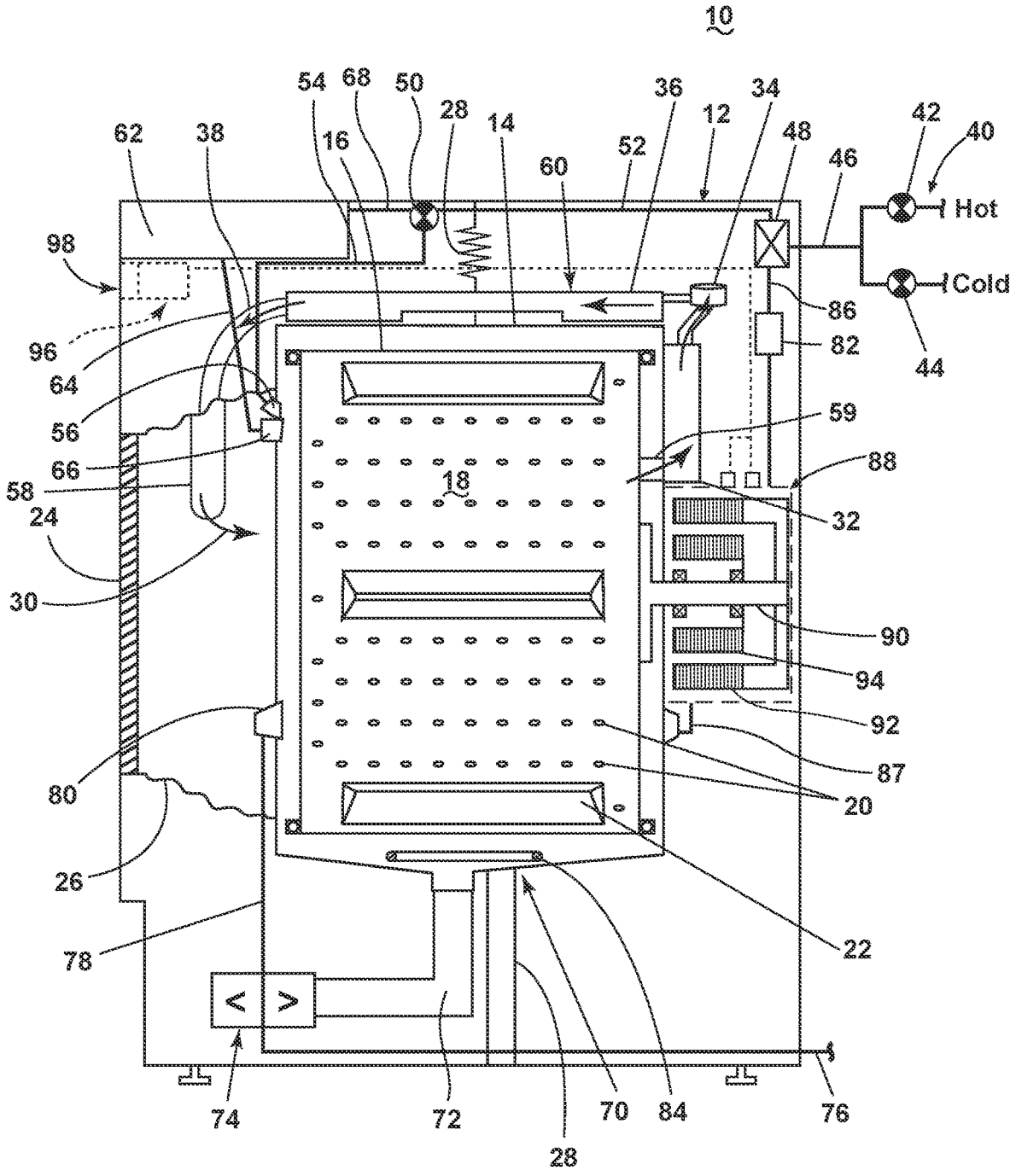
FIG. 1 illustrates a schematic cross-sectional view of a laundry treating appliance including a drying air circuit.

FIG. 1 is a schematic cross-sectional view of a laundry treating appliance 10 according to an aspect of the present disclosure. The laundry treating appliance 10 can be any laundry treating appliance 10 which performs a cycle of operation to clean or otherwise treat laundry items placed therein, non-limiting examples of which include a horizontal or vertical axis clothes washer; a horizontal or vertical axis clothes dryer; a combination washing machine and dryer; a tumbling or stationary refreshing/revitalizing machine; an extractor; a non-aqueous washing apparatus; and a revitalizing machine. While the laundry treating appliance 10 is illustrated herein as a horizontal axis, front-load laundry treating appliance 10, the aspects of the present disclosure can have applicability in laundry treating appliances with other configurations. The laundry treating appliance 10 shares many features of a conventional automated clothes washer and/or dryer, which will not be described in detail herein except as necessary for a complete understanding of the exemplary aspects in accordance with the present disclosure.

Laundry treating appliances are typically categorized as either a vertical axis laundry treating appliance or a horizontal axis laundry treating appliance. As used herein, the term "horizontal axis" laundry treating appliance refers to a laundry treating appliance having a rotatable drum that rotates about a generally horizontal axis relative to a surface that supports the laundry treating appliance. The drum can rotate about the axis inclined relative to the horizontal axis, with fifteen degrees of inclination being one example of the inclination. Similar to the horizontal axis laundry treating appliance, the term "vertical axis" laundry treating appliance refers to a laundry treating appliance having a rotatable drum that rotates about a generally vertical axis relative to a surface that supports the laundry treating appliance. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" laundry treating appliance refers to a laundry treating appliance having a rotatable drum, perforate or imperforate, that holds fabric items and, optionally, a clothes mover, such as an agitator, impeller, nutator, and the like within the drum. The clothes mover can move within the drum to impart mechanical energy directly to the clothes or indirectly through wash liquid in the drum. The clothes mover can typically be moved in a reciprocating rotational movement. In some vertical axis laundry treating appliances, the drum rotates about a vertical axis generally perpendicular to a surface that supports the laundry treating appliance. However, the rotational axis need not be vertical. The drum can rotate about an axis inclined relative to the vertical axis.

As used herein, the "horizontal axis" laundry treating appliance refers to a laundry treating appliance having a rotatable drum, perforated or imperforate, that holds laundry items and washes and/or dries the laundry items. In some horizontal axis laundry treating appliances, the drum rotates about a horizontal axis generally parallel to a surface that supports the laundry treating appliance. However, the rotational axis need not be horizontal. The drum can rotate about an axis inclined or declined relative to the horizontal axis. In horizontal axis laundry treating appliances, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a laundry treating appliance can be top-loading or front-loading. In a top-loading laundry treating appliance, laundry items are placed into the drum through an access opening in the top of a cabinet, while in a front-loading laundry treating appliance laundry items are placed into the drum through an access opening in the front of a cabinet. If a laundry treating appliance is a top-loading horizontal axis laundry treating appliance or a front-loading vertical axis laundry treating appliance, an additional access opening is located on the drum.

In more detail, the laundry treating appliance 10 is illustrated as a horizontal axis combination washing and drying laundry treating appliance 10, though it will be understood that the laundry treating appliance 10 need not be a combination washing and drying laundry treating appliance 10, but that any suitable laundry treating appliance 10 for drying laundry items can be provided, including a clothes dryer. The laundry treating appliance 10 can include a structural support assembly comprising a cabinet 12 which defines a housing within which a laundry holding assembly resides. The cabinet 12 can be a housing having a chassis and/or a frame, to which decorative panels can or cannot be mounted, defining an interior, enclosing components typically found in a conventional laundry treating appliance, such as motors, pumps, fluid lines, controls, sensors, transducers, and the like. Such components will not be described further herein except as necessary for a complete understanding of the present disclosure.

The laundry holding assembly of the illustrated laundry treating appliance 10 can include a tub 14 dynamically suspended within the structural support assembly of the cabinet 12 by a suitable suspension assembly 28, the tub 14 at least partially defining a treating chamber 18 for laundry items. A rotatable drum 16 can be provided within the tub 14 to further define at least a portion of the laundry treating chamber 18. The treating chamber 18 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, and a jacket.

The drum 16 can include a plurality of perforations 20 such that liquid can flow between the tub 14 and the drum 16 through the perforations 20. A plurality of baffles 22 can be disposed on an inner surface of the drum 16 to lift the laundry load received in the treating chamber 18 while the drum 16 rotates. It is also within the scope of the present disclosure for the laundry holding assembly to comprise only one receptacle, such as the tub 14 without the drum 16, or the drum 16 without the tub 14, with the single receptacle defining the laundry treating chamber 18 for receiving the load to be treated.

The laundry holding assembly can further include a closure, illustrated herein as a door assembly 24, which can be movably mounted to or coupled to the cabinet 12 to selectively close both the tub 14 and the drum 16, as well as the treating chamber 18. In one example, the door assembly 24 can be rotatable relative to the cabinet 12. By way of non-limiting example, the door assembly 24 can be hingedly coupled to the cabinet 12 for movement between an opened condition (not shown) and a closed condition as shown.

A bellows 26 can extend between the tub 14 and the cabinet 12 to couple an open face of the tub 14 with the cabinet 12, with the door assembly 24 sealing against the bellows 26 or the cabinet 12, or both, when the door assembly 24 closes the tub 14. In the opened condition, the door assembly 24 can be spaced apart from the bellows 26 and can allow access to the treating chamber 18. The bellows 26 can sealingly couple the open face of the tub 14 with the cabinet 12 such that liquid is not permitted to move from the tub 14 into the interior of the cabinet 12.

The laundry treating appliance 10 can optionally further comprise a washing circuit which can include a liquid supply assembly for supplying liquid, such as water or a combination of water and one or more wash aids, such as detergent, to the laundry treating appliance 10 for use in treating laundry during a cycle of operation. The liquid supply assembly can include a source of water, such as a household water supply 40, which can include separate valves 42 and 44 for controlling the flow of hot and cold water, respectively. The valves 42, 44 can be opened individually or together to provide a mix of hot and cold water at a selected temperature. The valves 42, 44 are selectively openable to provide water, such as from the household water supply 40, to be supplied through an inlet conduit 46 directly to the tub 14 or the drum 16 by controlling first and second diverter mechanisms 48 and 50, respectively. The diverter mechanisms 48, 50 can each be a diverter valve having two outlets such that each of the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 14 in a desired pattern and under a desired amount of pressure. For example, the spray nozzle 56 can be configured to dispense a flow or stream of water into the tub 14 by gravity, i.e. a non-pressurized stream. In this manner, water from the household water supply 40 can be supplied directly to the tub 14. While the valves 42, 44 and the conduit 46 are illustrated exteriorly of the cabinet 12, it will be understood that these components can be internal to the cabinet 12.

The laundry treating appliance 10 can also optionally be provided with a dispensing assembly for dispensing treating chemistry to the treating chamber 18 for use in treating the laundry according to a cycle of operation. The dispensing assembly can include a treating chemistry dispenser 62 which can be a single dose dispenser, a bulk dispenser, or an integrated single dose and bulk dispenser and is fluidly coupled to the treating chamber 18. The treating chemistry dispenser 62 can be configured to dispense a treating chemistry directly to the tub 14 or mixed with water from the liquid supply assembly through a dispensing outlet conduit 64. The treating chemistry dispenser 62 can include means for supplying or mixing detergent to or with water from the water supply 40. Alternatively or additionally, water from the water supply 40 can also be supplied to the tub 14 through the treating chemistry dispenser 62 without the addition of a detergent. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the treating chemistry dispenser 62 from the supply conduit 52 by directing the diverter mechanism 50 to direct the flow of water to a dispensing supply conduit 68.

The treating chemistry dispenser 62 can include multiple chambers or reservoirs for receiving doses of different treating chemistries. The treating chemistry dispenser 62 can be implemented as a dispensing drawer that is slidably received within the cabinet 12, or within a separate dispenser housing which can be provided in the cabinet 12. The treating chemistry dispenser 62 can be moveable between a fill position, where the treating chemistry dispenser 62 is exterior to the cabinet 12 and can be filled with treating chemistry, and a dispense position, where the treating chemistry dispenser 62 are interior of the cabinet 12.

Non-limiting examples of treating chemistries that can be dispensed by the dispensing assembly during a cycle of operation include one or more of the following: water, detergents, surfactants, enzymes, fragrances, stiffness/sizing agents, wrinkle releasers/reducers, softeners, antistatic or electrostatic agents, stain repellents, water repellents, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

The laundry treating appliance 10 can also include a recirculation and drain assembly for recirculating liquid within the laundry holding assembly and draining liquid from the laundry treating appliance 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can have an inlet fluidly coupled with the sump 70 and an outlet configured to fluidly couple and to direct liquid to a drain conduit 76, which can drain the liquid from the laundry treating appliance 10, or to a recirculation conduit 78, which can terminate at a recirculation inlet 80. In this configuration, the pump 74 can be used to drain or recirculate wash water in the sump 70. The recirculation inlet 80 can direct the liquid from the recirculation conduit 78 into the drum 16 by fluidly coupling the recirculation conduit 78 with the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry, can be recirculated into the treating chamber 18 for treating the laundry within. The recirculation and drain assembly can include other types of recirculation systems.

The liquid supply and/or recirculation and drain assembly can be provided with a heating assembly which can include one or more devices for heating laundry and/or liquid supplied to the tub 14, such as a steam generator 82 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation. The sump heater 84 can be provided within the sump 70 to heat liquid that collects in the sump 70. Alternatively, the heating assembly can include an in-line heater that heats the liquid as it flows through the liquid supply, dispensing, and/or recirculation assemblies.

It is noted that the illustrated suspension assembly, liquid supply assembly, recirculation and drain assembly, and dispensing assembly are shown for exemplary purposes only and are not limited to the assemblies shown in the drawings and described above. For example, the liquid supply, dispensing, and recirculation and pump assemblies can differ from the configuration shown in FIG. 1, such as by inclusion of other valves, conduits, treating chemistry dispensers, heaters, sensors (such as water level sensors and temperature sensors), and the like, to control the flow of liquid through the laundry treating appliance 10 and for the introduction of more than one type of treating chemistry. For example, the liquid supply assembly can include a single valve for controlling the flow of water from the household water source. In another example, the recirculation and pump assembly can include two separate pumps for recirculation and draining, instead of the single pump as previously described. In yet another example, the liquid supply assembly can be configured to supply liquid into the interior of the drum 16 or into the interior of the tub 14 not occupied by the drum 16, such that liquid can be supplied directly to the tub 14 without having to travel through the drum 16.

The laundry treating appliance 10 also includes a drive assembly for rotating the drum 16 within the tub 14. The drive assembly can include a motor 88, which can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled to the drum 16 through a belt and a drive shaft to rotate the drum 16, as is known in the art. Other motors, such as an induction motor or a permanent split capacitor (PSC) motor, can also be used.

The motor 88 can rotationally drive the drum 16, including that the motor 88 can rotate the drum 16 at various speeds in either rotational direction. In particular, the motor 88 can rotate the drum 16 at tumbling speeds wherein the laundry items in the drum 16 rotate with the drum 16 from a lowest location of the drum 16 towards a highest location of the drum 16, but fall back to the lowest location of the drum 16 before reaching the highest location of the drum 16. The rotation of the laundry items with the drum 16 can be facilitated by the baffles 22. Typically, the force applied to the laundry items at the tumbling speeds is less than about 1 G. Alternatively, the motor 88 can rotate the drum 16 at spin speeds wherein the laundry items rotate with the drum 16 without falling. The spin speeds can also be referred to as satellizing speeds or sticking speeds. Typically, the force applied to the laundry items at the spin speeds is greater than or about equal to 1 G. As used herein, "tumbling" of the drum 16 refers to rotating the drum 16 at a tumble speed, "spinning" the drum 16 refers to rotating the drum 16 at a spin speed, and "rotating" of the drum 16 refers to rotating the drum 16 at any speed.

The laundry treating appliance 10 can further comprise a drying air circuit 60 fluidly coupled to the treating chamber 18 for drying laundry items. The drying air circuit 60 can be a closed loop circuit or an open loop circuit. The drying air circuit 60 can comprise a treating chamber air inlet 58 and a treating chamber air outlet 59, and specifically can be fluidly coupled with the treating chamber air inlet 58 and the treating chamber air outlet 59 and configured to supply drying air through the treating chamber 18 from the treating chamber air inlet 58 to the treating chamber air outlet 59. While the treating chamber air inlet 58 is illustrated herein as being provided on the bellows 26, it will be understood that the treating chamber air inlet 58 can be any provided at any suitable position of the treating chamber 18, including as an opening in at least one of the drum 16 or the tub 14. The treating chamber air outlet 59 is illustrated herein as being provided at a rear wall of the tub 14, the drum 16, and the treating chamber 18, though such a position is not limiting. The treating chamber air inlet 58 and the treating chamber air outlet 59 can be provided at any suitable locations of the treating chamber 18 so long as they are spaced from one another to allow drying air to flow through the treating chamber 18.

In one example, the drying air circuit 60 can be provided as a closed loop, or recirculating, drying air circuit 60, as illustrated herein. The closed loop drying air circuit 60 can define a drying air flow pathway, as indicated by the arrows 30, to recirculate air through the treating chamber 18. The closed loop drying air circuit 60 can include a condenser 32, a blower 34, a heating portion 36, and a drying air conduit 38. The condenser 32 can be provided with a condenser drain conduit (not shown) that fluidly couples the condenser 32 with the pump 74 and the drain conduit 76. Condensed liquid collected within the condenser 32 can flow through the condenser drain conduit to the pump 74, where it can be provided to the recirculation and drain assembly. The blower 34 is fluidly coupled to the treating chamber 18 such that actuation of the blower 34 supplies or circulates air through the treating chamber 18 by flowing air from the treating chamber air inlet 58 to the treating chamber air outlet 59. The heating portion 36 can enclose at least one heater or heating element (not shown) that is configured to heat recirculating air that flows through the drying air circuit 60. In one example, the drying air circuit 60 can be provided adjacent an upper portion of the tub 14, though it will be understood that the drying air circuit 60 need not be provided adjacent the upper portion of the tub 14, and can be provided at any suitable location adjacent the tub 14 or the treating chamber 18.

In one example, the drying air flow pathway 30 can pass through the components of the closed loop drying air circuit 60 such that air exiting the treating chamber 18 through the treating chamber air outlet 59 flows through the condenser 32, through the blower 34, through the heating portion 36 to be heated to become drying air, and then through the drying air conduit 38 to enter the treating chamber 18 through the treating chamber air inlet 58. However, while the blower 34 is illustrated herein as being provided in between the condenser 32 and the heating portion 36, and specifically downstream of the condenser 32 and upstream of the heating portion 36, it will be understood that the blower 34 can be provided at any suitable location within the drying air circuit 60 so as to drive the supply of air along the drying air flow pathway 30. By way of non-limiting example, the blower 34 can be provided between the treating chamber air outlet 59 and the condenser 32 or between the heating portion 36 and the treating chamber air inlet 58. Further, while the closed loop drying air circuit 60 is illustrated herein as including both the condenser 32 and the heating portion 36, it will be understood that the closed loop drying air circuit 60 could also include the condenser 32, but not the heating portion 36, or could include the heating portion 36, but not the condenser 32.

When the drying air circuit 60 is provided as an open loop drying air circuit 60, the condenser 32 is not necessary. Alternatively, the blower 34, instead of being fluidly coupled with the condenser 32, can be fluidly coupled with an ambient air source, which can draw ambient air either from within the cabinet 12 or from the exterior of the cabinet 12. The ambient air can be provided from the blower 34 to the heating portion 36 to be heated to be provided through the drying air conduit 38 to enter the treating chamber 18 through the treating chamber air inlet 58. Air that flows through the treating chamber 18 and gathers moisture from the laundry items within the treating chamber 18, and is then exhausted through the treating chamber air outlet 59 and can be exhausted to the exterior of the cabinet 12. As the drying air is not being recirculated to the treating chamber 18, no condensing is necessary. In such an example, while the blower 34 is illustrated as being provided upstream of the heating portion 36, it will also be understood that the blower 34 can be provided between the heating portion 36 and the treating chamber air inlet 58. Additionally or alternatively, the same blower 34 or an additional blower 34 can be provided downstream of the treating chamber air outlet 59 to draw the exhaust air out of the treating chamber 18.

The laundry treating appliance 10 also includes a control assembly for controlling the operation of the laundry treating appliance 10 and its various working components to control the operation of the working components and to implement one or more treating cycles of operation. The control assembly can include a controller 96 located within the cabinet 12 and a user interface 98 that is operably coupled with the controller 96. The user interface 98 can provide an input and output function for the controller 96. In one example, the user interface 98 can be provided or integrated with the door assembly 24. In another example, as shown, the user interface 98 can be provided on a front panel of the cabinet 12.

The user interface 98 can include one or more knobs, dials, switches, displays, touch screens and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the laundry treating appliance 10 and can allow the controller 96 to communicate with the user in a variety of ways. For example, the controller 96 can be configured to send a text message to the user, send an electronic mail to the user, or provide audio information to the user either through the laundry treating appliance 10 or utilizing another device such as a mobile phone.

The controller 96 can include the machine controller and any additional controllers provided for controlling any of the components of the laundry treating appliance 10. For example, the controller 96 can include the machine controller and a motor controller. Many known types of controllers can be used for the controller 96. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
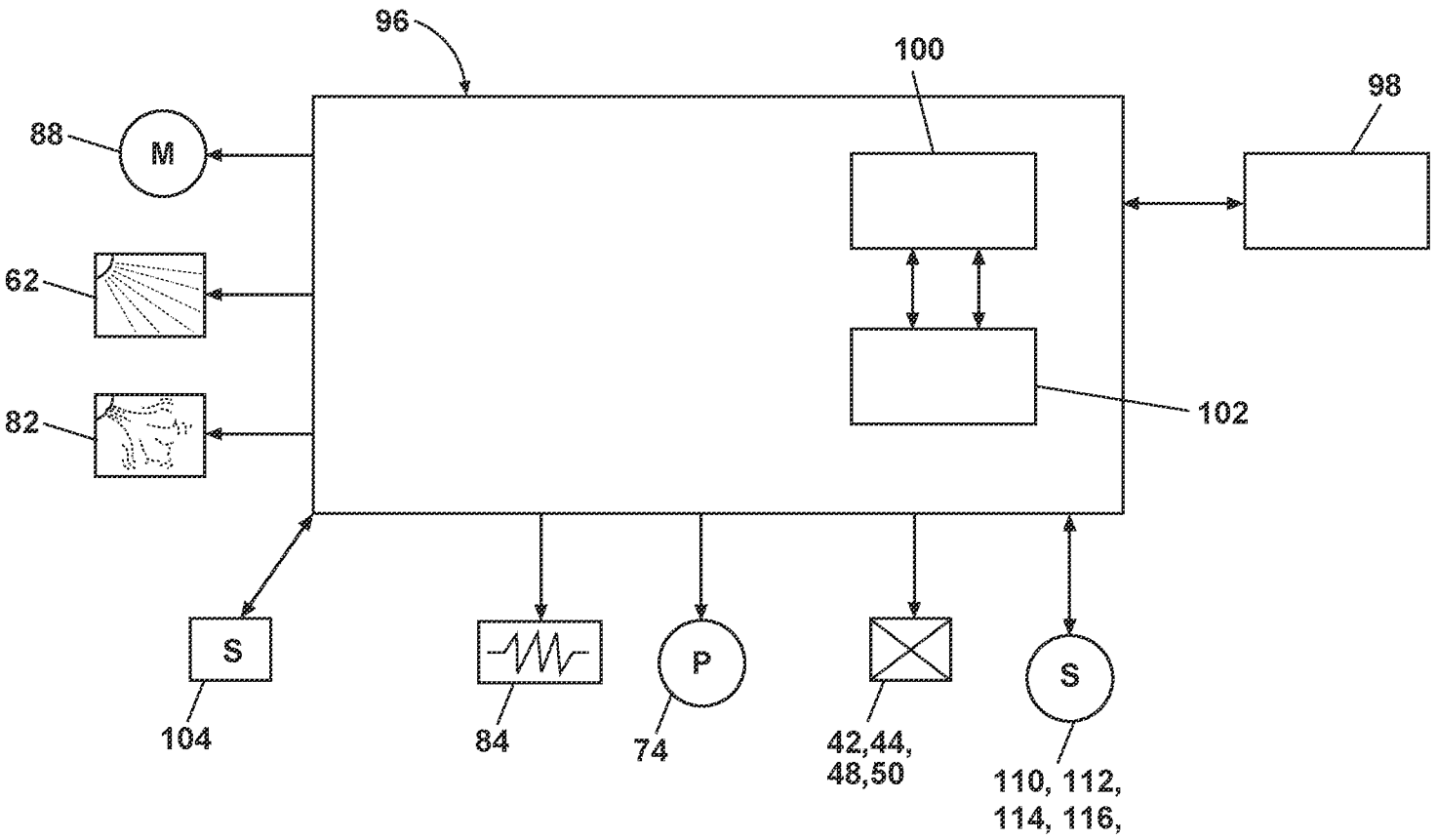
FIG. 2 illustrates a schematic of a control assembly of the laundry treating appliance of FIG. 1.

As illustrated in FIG. 2, the controller 96 can be provided with a memory 100 and a central processing unit (CPU) 102. The memory 100 can be used for storing the control software that is executed by the CPU 102 in completing a cycle of operation using the laundry treating appliance 10 and any additional software. For example, the memory 100 can store a set of executable instructions including at least one user-selectable cycle of operation. Examples, without limitation, of cycles of operation include: wash, heavy duty wash, delicate wash, quick wash, pre-wash, refresh, rinse only, timed wash, dry, heavy duty dry, delicate dry, quick dry, or automatic dry, which can be selected at the user interface 98. The memory 100 can also be used to store information, such as a database or table, and to store data received from one or more components of the laundry treating appliance 10 that can be communicably coupled with the controller 96. The database or table can be used to store the various operating parameters for the one or more cycles of operation, including factory default values for the operating parameters and any adjustments to them by the control assembly or by user input.

The controller 96 can be operably coupled with one or more components of the laundry treating appliance 10 for communicating with and controlling the operation of the component to complete a cycle of operation. For example, the controller 96 can be operably coupled with the valves 42, 44 and the diverter mechanisms 48, 50 for controlling the temperature and flow rate of treating liquid into the treating chamber 18, the motor 88 for controlling the direction and speed of rotation of the drum 16, the pump 74 for controlling the amount of treating liquid in the treating chamber 18 or sump 70, the treating chemistry dispenser 62 for controlling the flow of treating chemistries into the treating chamber 18, the user interface 98 for receiving user selected inputs and communicating information to the user, the steam generator 82, the sump heater 84, and the drying air circuit 60, including the blower 34 and the heating portion 36, to control the operation of these and other components to implement one or more of the cycles of operation.

The controller 96 can also be coupled with one or more sensors 104 provided in one or more of the assemblies of the laundry treating appliance 10 to receive input from the sensors 104, which are known in the art and not shown for simplicity. Non-limiting examples of sensors 104 that can be communicably coupled with the controller 96 include: a treating chamber temperature sensor, such as a thermistor, which can detect the temperature of the treating liquid in the treating chamber 18 and/or the temperature of the treating liquid being supplied to the treating chamber 18, a moisture sensor, a weight sensor, a chemical sensor, a position sensor, an imbalance sensor, a load size sensor, and a motor torque sensor, which can be used to determine a variety of assembly and laundry characteristics, such as laundry load inertia or mass. In one example, a characteristic that can be determined by the controller 96 based on input from sensors 104 can include an estimated or assumed air flow rate or mass flow level through the drying air circuit 60 and/or through the treating chamber 18.

In one specific example, the laundry treating appliance 10 can include a first temperature sensor 110, a second temperature sensor 112, a first humidity sensor 114, and optionally a second humidity sensor 116, all of which are operably and communicably coupled with the controller 96 for use in determining an evaporation rate of moisture remaining in the laundry load, a dryness level of the laundry load, and an estimated remaining drying time for the laundry load. These sensors 110, 112, 114, 116 can be provided at a variety of locations within the laundry treating appliance 10, as will be discussed further. Depending on the location of the sensors 110, 112, 114, 116, it may be beneficial to provide structures to protect the sensors 110, 112, 114, 116 from the environment of the laundry treating appliance 10, such as shields or doors to protect from liquid, or mesh screens to protect from lint.

Figure 3:
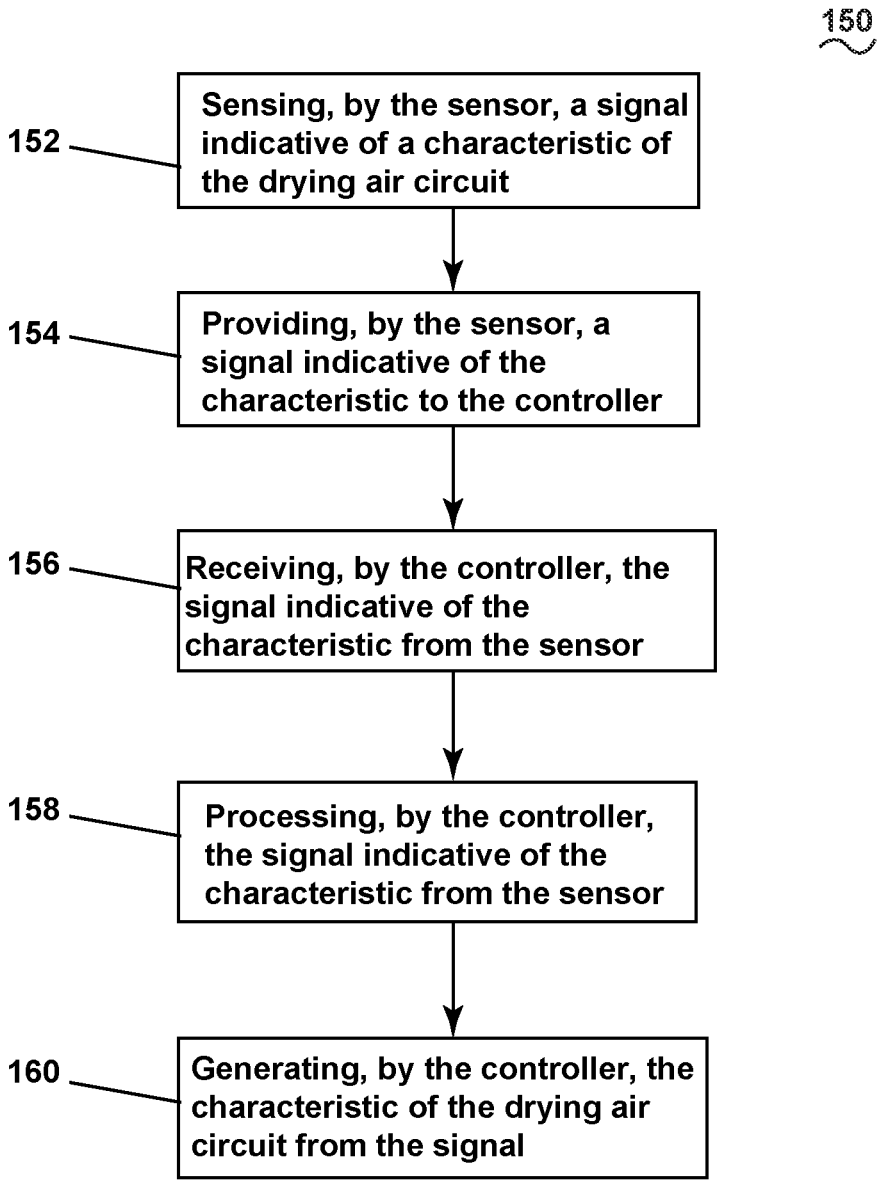
FIG. 3 is a flow diagram illustrating an example of a method of operating the control assembly of FIG. 2 to receive inputs from sensors that can be provided with the laundry treating appliance.

Referring now to FIG. 3, a method 150 of operating the controller 96 to receive and process signals from the first temperature sensor 110, the second temperature sensor 112, the first humidity sensor 114, and optionally the second humidity sensor 116, is described. Traditional methods of estimating the dryness of a laundry load and an estimated drying time remaining for the laundry load may rely on imprecise sensors, such as moisture strips, that lose sensitivity and accuracy once the moisture level in the laundry load falls below a particular point. Thus, more precise methods of estimating dryness of a laundry load and estimated drying time remaining can offer an improvement. However, precise sensors result in increased cost. Thus, it can be useful to develop methods of determining these values while minimizing the additional sensors needed, such as by using outputs from one sensor to estimate or calculate a related value without the cost of including an additional sensor to directly sense the related value. One example of such a strategy is to provide the controller 96 for determining the evaporation rate of moisture remaining in the laundry load, the dryness level of the laundry load, and an estimated remaining drying time for the laundry load, based on the inputs from the first temperature sensor 110, the second temperature sensor 112, and the first humidity sensor 114, without the need for the second humidity sensor 116. Instead of including the second humidity sensor 116 and its associated cost, the inputs from the first temperature sensor 110, the second temperature sensor 112, and the first humidity sensor 114 can be used to calculate or estimate a humidity value that would otherwise be sensed by the second humidity sensor 116, which is then used in the determination of the evaporation rate, the dryness level, and the estimated remaining drying time.

The first temperature sensor 110 can be provided in the drying air circuit 60 and, at 152, configured to sense a signal indicative of an inlet air temperature of the air entering the treating chamber 18 through the treating chamber air inlet 58. The first temperature sensor 110 can be any suitable type of temperature sensor. The first temperature sensor 110 can directly sense the inlet air temperature, or it can sense a signal indicative of the inlet air temperature, by way of non-limiting example, a voltage or the like, which can be converted into a value corresponding to the inlet air temperature or used without conversion to determine the inlet air temperature value. At 154, the first temperature sensor 110 then provides a signal indicative of the inlet air temperature to the controller 96. At 156, the controller 96 receives the signal indicative of the inlet air temperature from the first temperature sensor 110 and, at 158, processes the signal from the first temperature sensor 110, and further, at 160, generates the inlet air temperature from the signal received from the first temperature sensor 110. The first temperature sensor 110 can be provided at any suitable location within the drying air circuit 60 such that it can sense the inlet air temperature. By way of non-limiting example, the first temperature sensor 110 can be provided adjacent the treating chamber air inlet 58, between the heating portion 36 and the treating chamber air inlet 58 such that the first temperature sensor 110 is downstream of the heating portion 36 and upstream of the treating chamber air inlet 58, or, in the case that the heating portion 36 is not included, between the condenser 32 and the treating chamber air inlet 58. In the case that the drying air circuit 60 is an open loop drying air circuit 60, the first temperature sensor 110 can be provided at a cabinet inlet where ambient air enters the cabinet 12.

The second temperature sensor 112 can be provided in the drying air circuit 60 and, at 152, configured to sense a signal indicative of an outlet air temperature of the air exiting the treating chamber 18 through the treating chamber air outlet 59. The second temperature sensor 112 can be any suitable type of temperature sensor. The second temperature sensor 112 can directly sense the outlet air temperature, or it can sense a signal indicative of the outlet air temperature, by way of non-limiting example, a voltage or the like, which can be converted into a value corresponding to the outlet air temperature or used without conversion to determine the outlet air temperature value. At 154, the second temperature sensor 112 then provides a signal indicative of the outlet air temperature to the controller 96. At 156, the controller 96 receives the signal indicative of the outlet air temperature from the second temperature sensor 112 and, at 158, processes the signal from the second temperature sensor 112, and further, at 160, generates the outlet air temperature from the signal received from the second temperature sensor 112. The second temperature sensor 112 can be provided at any suitable location within the drying air circuit 60 such that it can sense the outlet air temperature. By way of non-limiting example, the second temperature sensor 112 can be provided adjacent the treating chamber air outlet 59, between the treating chamber air outlet 59 and either the condenser 32 or the heating portion 36, or between the treating chamber air inlet 58 and either the condenser 32 or the heating portion 36. In the case that the drying air circuit 60 is an open loop drying air circuit 60, the second temperature sensor 112 can be provided at a cabinet exhaust where the air is exhausted from and exits the cabinet 12.

The first humidity sensor 114 can be provided in the drying air circuit 60 and, at 152, configured to sense a signal indicative of an inlet air humidity value of the air entering the treating chamber 18 through the treating chamber air inlet 58. The first humidity sensor 114 can be any suitable type of humidity sensor. The first humidity sensor 114 can directly sense the inlet air humidity, or it can sense a signal indicative of the inlet air humidity, by way of non-limiting example, a voltage or the like, which can be converted into a value corresponding to the inlet air humidity or used without conversion to determine the inlet air humidity value. At 154, the first humidity sensor 114 then provides a signal indicative of the inlet air humidity to the controller 96. At 156, the controller 96 receives the signal indicative of the inlet air humidity from the first humidity sensor 114 and, at 158, processes the signal from the first humidity sensor 114, and further, at 160, generates the inlet air humidity value from the signal received from the first humidity sensor 114. In one example, the generated inlet air humidity value is an inlet air relative humidity value. The first humidity sensor 114 can be provided at any suitable location within the drying air circuit 60 such that it can sense the inlet air humidity. By way of non-limiting example, the first humidity sensor 114 can be provided adjacent the treating chamber air inlet 58, between the heating portion 36 and the treating chamber air inlet 58 such that the first humidity sensor 114 is downstream of the heating portion 36 and upstream of the treating chamber air inlet 58, or, in the case that the heating portion 36 is not included, between the condenser 32 and the treating chamber air inlet 58. In the case that the drying air circuit 60 is an open loop drying air circuit 60, the first humidity sensor 114 can be provided at a cabinet inlet where ambient air enters the cabinet 12.

As described previously, methods are disclosed herein for estimating a humidity value that could otherwise be sensed by the second humidity sensor 116, by using the outputs from the first temperature sensor 110, the second temperature sensor 112, and the first humidity sensor 114 to calculate or estimate such a humidity value. In this way, the additional cost of providing the second humidity sensor 116 is avoided. However, in some cases, increased precision in determining the remaining drying time may be desired, or an example laundry treating appliance 10 may already include a second humidity sensor 116. In such cases, the second humidity sensor 116 can be included and its output used in the determinations made by the controller 96. In these cases, the laundry treating appliance 10 can optionally further include the second humidity sensor 116. The second humidity sensor 116 can be provided in the drying air circuit 60 and, at 152, configured to sense a signal indicative of an outlet air humidity value of the air exiting the treating chamber 18 through the treating chamber air outlet 59. The second humidity sensor 116 can be any suitable type of humidity sensor. The second humidity sensor 116 can directly sense the outlet air humidity, or it can sense a signal indicative of the outlet air humidity, by way of non-limiting example, a voltage or the like, which can be converted into a value corresponding to the outlet air humidity or used without conversion to determine the outlet air humidity value. At 154, the second humidity sensor 116 then provides a signal indicative of the outlet air humidity to the controller 96. At 156, the controller 96 receives the signal indicative of the outlet air humidity from the second humidity sensor 116 and, at 158, processes the signal from the second humidity sensor 116, and further, at 160, generates the outlet air humidity value from the signal received from the second humidity sensor 116. In one example, the generated outlet air humidity value is an outlet air relative humidity value. The second humidity sensor 116 can be provided at any suitable location within the drying air circuit 60 such that it can sense the outlet air humidity. By way of non-limiting example, the second humidity sensor 116 can be provided adjacent the treating chamber air outlet 59, between the treating chamber air outlet 59 and either the condenser 32 or the heating portion 36, or between the treating chamber air inlet 58 and either the condenser 32 or the heating portion 36. In the case that the drying air circuit 60 is an open loop drying air circuit 60, the second humidity sensor 116 can be provided at a cabinet exhaust where the air is exhausted from and exits the cabinet 12.

Figure 4:
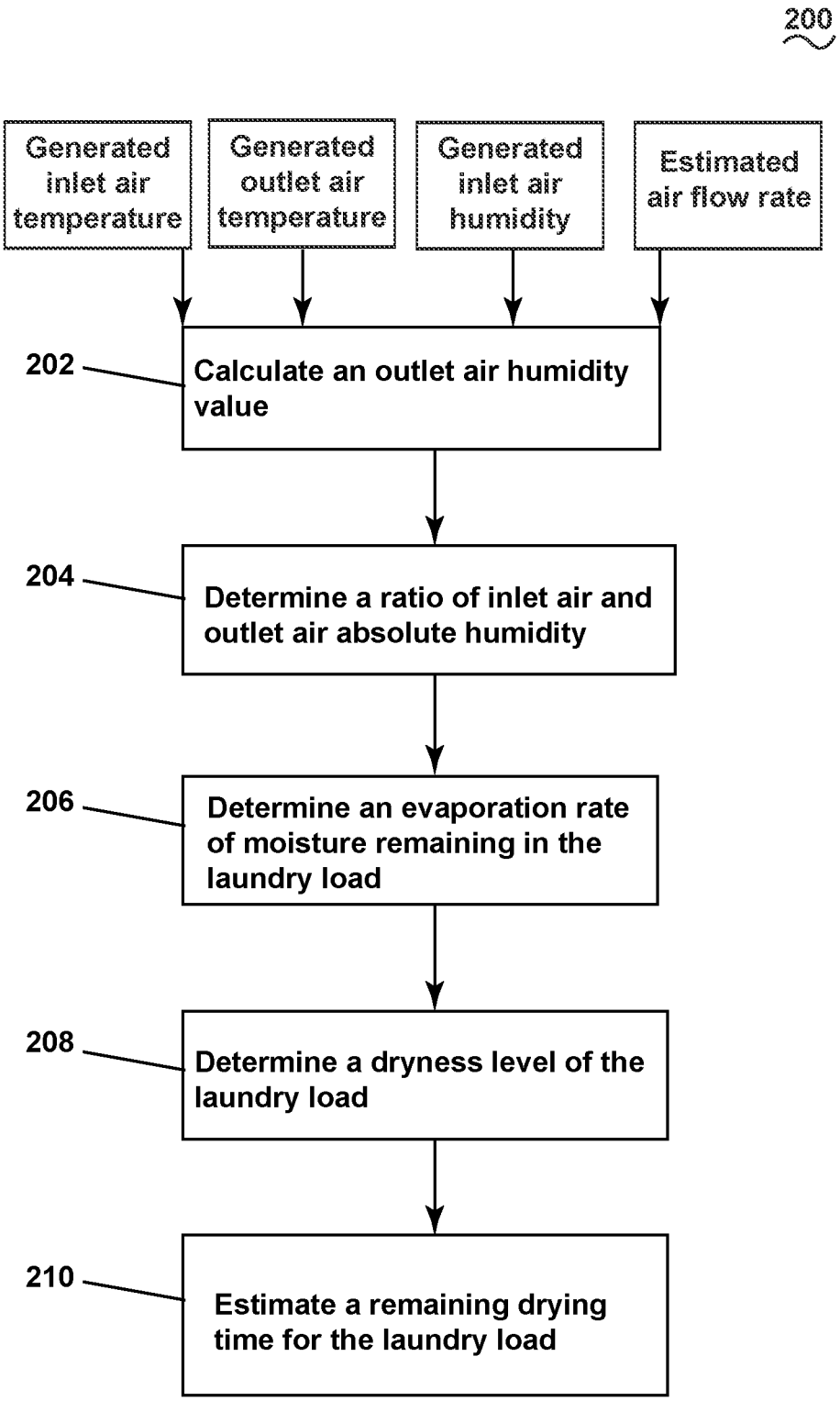
FIG. 4 is a flow diagram illustrating an example of a method of operating the control assembly of FIG. 2 to determine characteristics of a laundry load based on the inputs from the sensors of FIG. 3.

Referring now to FIG. 4, a method 200 of operating the controller 96 to determine an evaporation rate of moisture remaining in the laundry load, a dryness level of the laundry load, and an estimated remaining drying time for the laundry load using the first temperature sensor 110, the second temperature sensor 112, and the first humidity sensor 114 is described. At 202, using the generated inlet air temperature, the generated outlet air temperature, the generated inlet air relative humidity, and the estimated air flow rate determined by the controller 96 as inputs to an algorithm or model, the controller 96 is further configured to determine, such as by calculating or estimating, an outlet air humidity value of the air exiting the treating chamber 18 at the treating chamber air outlet 59, without the need for and the cost of including the second humidity sensor 116. At 204, and using the same inputs as at 202 and additionally using the determined outlet air humidity value as an input, the controller 96 determines an inlet air absolute humidity value and an outlet air absolute humidity value, based upon the sensed and determined relative humidity values and together with inlet air and outlet air temperatures, then calculates a ratio of the absolute humidity of the inlet air and the outlet air. Specifically, absolute humidity can be calculated based on relative humidity, along with inlet air temperature and outlet air temperature. At 206, based on the calculated ratio of the absolute humidity of the inlet air and the outlet air, the controller 96 determines an evaporation rate of the moisture remaining in the laundry load within the treating chamber 18. At 208, the controller 96 determines a dryness level of the laundry load, based upon the generated input values and the calculated evaporation rate of the laundry load. At 210, the controller 96 estimates a remaining drying time for the laundry load based on the dryness level of the laundry load and the calculated evaporation rate of the laundry load.

Figure 5:
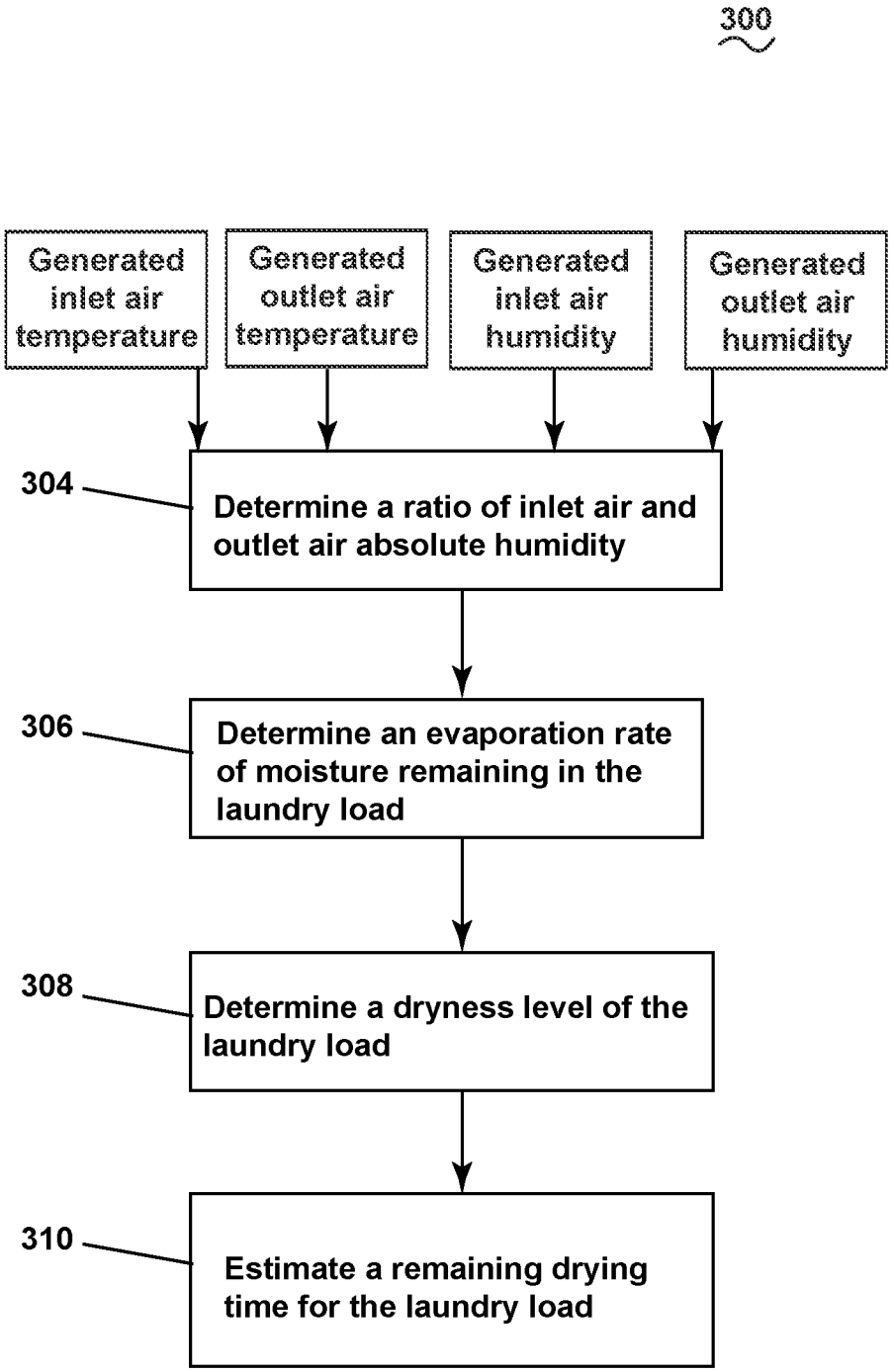
FIG. 5 is a flow diagram illustrating another example of a method of operating the control assembly of FIG. 2 to determine characteristics of a laundry load based on the inputs from the sensors of FIG. 3.

Referring now to FIG. 5, a method 300 of operating the controller 96 to determine an evaporation rate of moisture remaining in the laundry load, a dryness level of the laundry load, and an estimated remaining drying time for the laundry load using the first temperature sensor 110, the second temperature sensor 112, the first humidity sensor 114, and the second humidity sensor 116 is described. As described previously, in some cases it is desirable to omit the second humidity sensor 116 in order to save costs, and this can be accomplished by the methods of estimating outlet air humidity as discussed. However, in other cases, the particular laundry treating appliance 10 may already include the second humidity sensor 116, or it may be the case that the improved precision of the estimated remaining drying time obtained when the second humidity sensor 116 is included may outweigh the increased cost of including the second humidity sensor 116. In such cases, and because the second humidity sensor 116 provides a generated outlet air humidity value as an input to the controller 96, it is not necessary to calculate the outlet air humidity value as at step 202 of the method 200. In the method 300, rather, and at 304, using the generated inlet air temperature, the generated outlet air temperature, the generated inlet air relative humidity, and the generated outlet air relative humidity determined by the controller 96 as inputs to an algorithm or model, the controller 96 determines an inlet air absolute humidity value and an outlet air absolute humidity value, then calculates a ratio of the absolute humidity of the inlet air and the outlet air. At 306, based on the calculated ratio of the absolute humidity of the inlet air and the outlet air, the controller 96 determines an evaporation rate of the moisture remaining in the laundry load within the treating chamber 18. At 308, the controller 96 determines a dryness level of the laundry load, based upon the generated input values and the calculated evaporation rate of the laundry load. At 310, the controller 96 estimates a remaining drying time for the laundry load based on the dryness level of the laundry load and the calculated evaporation rate of the laundry load.

While the methods 200, 300 described herein disclose a specific set of input parameters or values, it will be understood that additional inputs can be included to further refine the methods. For example, a load type or fabric type of the laundry load, based on a cycle selection input, can also be included to account for load type when determining dryness, evaporation, and remaining drying time.

The aspects of the present disclosure described herein set forth apparatus and methods for improved accuracy and precision in estimating a remaining drying time of a laundry load and of a targeted dryness level of the laundry load. Traditional moisture detection methods for clothes loads being dried include the use of moisture strips, which tend to exhibit loss of electrical signal once the moisture content in the laundry load drops below 15-20%. The methods described herein allow for accurate and precise moisture detection throughout the dryness range of the laundry load. The inclusion of such sensors as a humidity sensor at a cabinet inlet can further improve algorithm inputs by assessing the environmental conditions that can vary with geographic region or season of the year. Even with the addition of only one inlet air humidity sensor, improved accuracy over tradition methods can be realized. With the addition of first and second humidity sensors for inlet air and outlet air, the calculation becomes even more accurate. The calculations and determinations disclosed herein can also allow for incorporating load type for further accuracy, and can even be used for avoiding unwanted static electricity in the laundry load by ensuring that drying is stopped when a sufficient amount of moisture remains in the laundry load such that the laundry load feels dry to a user, but is not over-dry so as to result in static.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A laundry treating appliance for treating laundry according to an automatic cycle of operation, the laundry treating appliance comprising:

a cabinet defining a cabinet interior;

a drum, rotatable within the cabinet interior, and at least partially defining a treating chamber, the treating chamber having a treating chamber air inlet and a treating chamber air outlet;

a drying air circuit fluidly coupled to the treating chamber air inlet and to the treating chamber air outlet;

a first air temperature sensor provided in the drying air circuit and outputting a first signal indicative of an inlet air temperature of drying air in the drying air circuit that flows through the treating chamber air inlet;

a second air temperature sensor provided in the drying air circuit and outputting a second signal indicative of an outlet air temperature of the drying air exiting the treating chamber air outlet;

at least a first humidity sensor provided in the drying air circuit and outputting a third signal indicative of an inlet air humidity value of the drying air entering the treating chamber air inlet; and a controller estimating an air flow rate through the drying air circuit, and further operably coupled with the first and second air temperature sensors and the first humidity sensor to receive and process the first, second, and third signals and the estimated air flow rate to determine an outlet air humidity value of the drying air exiting the treating chamber air outlet.

2. The laundry treating appliance of claim 1 wherein the controller further determines an evaporation rate of moisture remaining in the laundry based on the determined outlet air humidity value.

3. The laundry treating appliance of claim 2 wherein the controller further determines a dryness level of the laundry based on the determined evaporation rate of moisture remaining in the laundry.

4. The laundry treating appliance of claim 3 wherein an estimated remaining drying time for the laundry is estimated based on the determined dryness level and the determined evaporation rate of the laundry.

5. The laundry treating appliance of claim 1 further comprising a second humidity sensor provided in the drying air circuit and outputting a fourth signal indicative of an outlet air humidity value of the drying air exiting the treating chamber air outlet.

6. The laundry treating appliance of claim 5 wherein the controller is operably coupled with the second humidity sensor to receive and process the fourth signal to determine an evaporation rate of moisture remaining in the laundry based on the inlet air temperature, the outlet air temperature, the inlet air humidity value, and the outlet air humidity value.

7. The laundry treating appliance of claim 6 wherein the determined evaporation rate of moisture remaining in the laundry is further based on the estimated air flow rate.

8. The laundry treating appliance of claim 1 wherein the inlet air humidity value is a relative humidity value.

9. The laundry treating appliance of claim 8 wherein the controller determines an absolute inlet air humidity value based on the inlet air temperature, the outlet air temperature, and the inlet air relative humidity value.

10. The laundry treating appliance of claim 1 wherein the laundry treating appliance is a combination washing and drying treating appliance.

11. The laundry treating appliance of claim 10 further comprising a tub defining a tub interior, the drum provided within the tub interior, and the tub interior configured to receive wash liquid during a washing cycle of operation.

12. The laundry treating appliance of claim 1 wherein the drying air circuit is one of a closed loop circuit and an open loop circuit.

13. The laundry treating appliance of claim 1 wherein the drying air circuit comprises a blower fluidly coupled to the treating chamber, whereby actuation of the blower circulates air through the treating chamber by flowing air from the treating chamber air inlet to the treating chamber air outlet.

14. The laundry treating appliance of claim 13 wherein the air flowing from the treating chamber air inlet to the treating chamber air outlet is returned to the treating chamber air inlet via the drying air circuit.

15. A laundry treating appliance for treating laundry according to an automatic cycle of operation, the laundry treating appliance comprising:

a cabinet defining a cabinet interior;

a drum, rotatable within the cabinet interior, and at least partially defining a treating chamber, the treating chamber having a treating chamber air inlet and a treating chamber air outlet;

a drying air circuit fluidly coupled to the treating chamber air inlet and to the treating chamber air outlet, wherein the drying air circuit is a closed loop circuit;

a first air temperature sensor provided in the drying air circuit and outputting a first signal indicative of a first air temperature of drying air in the drying air circuit;

a second air temperature sensor provided in the drying air circuit and outputting a second signal indicative of a second air temperature of the drying air in the drying air circuit;

at least a first humidity sensor provided in the drying air circuit and outputting a third signal indicative of a first air humidity value of the drying air; and a controller estimating an air flow rate through the drying air circuit, and further operably coupled with the first and second air temperature sensors and the first humidity sensor to receive and process the first, second, and third signals and the estimated air flow rate to determine a second air humidity value of the drying air and to estimate a remaining drying time for the laundry based on the determined second air humidity value.

16. A method of operating a laundry treating appliance with a treating chamber for treating a load of laundry according to a drying cycle of operation, the method comprising:

supplying, by a drying air circuit, drying air to the treating chamber during the drying cycle of operation;

sensing, with a first air temperature sensor provided in the drying air circuit, a first signal indicative of an inlet air temperature of the drying air in the drying air circuit that flows through a treating chamber air inlet;

sensing, with a second air temperature sensor provided in the drying air circuit, a second signal indicative of an outlet air temperature of the drying air exiting a treating chamber air outlet;

sensing, with at least a first humidity sensor provided in the drying air circuit, a third signal indicative of an inlet air humidity value of the drying air entering the treating chamber air inlet;

estimating, by a controller, an air flow rate through the treating chamber; and determining, by the controller, an outlet air humidity value based on the first, second, and third signals and the estimated air flow rate.

17. The method of claim 16 further comprising determining, by the controller, an evaporation rate of moisture remaining in the load of laundry based on the determined outlet air humidity value.

18. The method of claim 17 further comprising determining, by the controller, a dryness level of the load of laundry based on the determined evaporation rate of moisture remaining in the load of laundry.

19. The method of claim 18 further comprising estimating, by the controller, a remaining drying time for the load of laundry based on the determined dryness level and the determined evaporation rate of the load of laundry.

20. The method of claim 16 further comprising:

sensing, with a second humidity sensor provided in the drying air circuit, a fourth signal indicative of an outlet air humidity value of the drying air exiting the treating chamber air outlet; and determining, by the controller, an evaporation rate of moisture remaining in the load of laundry based on the first, second, third, and fourth signals.

* * * * *